US006102340A

United States Patent [19]

Peek et al.

[11] Patent Number: 6,102,340

[45] Date of Patent: Aug. 15, 2000

[54] BROKEN RAIL DETECTION SYSTEM AND METHOD

[75] Inventors: Ernest Peek, Cocoa, Fla.; Wayne Basta, Saginaw, Tex.

[73] Assignee: GE-Harris Railway Electronics, LLC, Melbourne, Fla.

[21] Appl. No.: 09/019,166

[22] Filed: Feb. 6, 1998

Related U.S. Application Data

[60] Provisional application No. 60/038,695, Feb. 7, 1997.

[51] Int. Cl.[7] ..... B61L 23/00

[52] U.S. Cl. ..... 246/121; 246/34 R; 246/122 R; 246/220; 246/246; 246/255

[58] Field of Search ..... 246/34 R, 40, 246/34 B, 41, 54, 118, 120, 121, 122 R, 122 A, 220, 246, 255; 324/713, 718

[56] References Cited

U.S. PATENT DOCUMENTS

| | | | |
|---|---|---|---|
| 1,816,182 | 7/1931 | Failor | 246/34 R |
| 2,014,015 | 9/1935 | Blosser | 246/34 R |
| 2,281,890 | 5/1942 | Staples | 246/34 R |
| 3,428,868 | 2/1969 | Duckitt et al. | 246/34 R |
| 3,432,653 | 3/1969 | Winks et al. | 246/34 R |
| 3,850,390 | 11/1974 | Geiger . | |
| 3,952,977 | 4/1976 | Verneulen | 246/34 R |
| 4,117,529 | 9/1978 | Stark et al. . | |
| 4,306,694 | 12/1981 | Kuhn . | |
| 4,581,700 | 4/1986 | Farnham et al. . | |
| 4,728,063 | 3/1988 | Petit et al. . | |
| 4,886,226 | 12/1989 | Frielinghaus . | |
| 5,145,131 | 9/1992 | Franke . | |
| 5,222,010 | 6/1993 | Capan | 361/56 |
| 5,330,135 | 7/1994 | Roberts . | |
| 5,417,388 | 5/1995 | Stillwell | 246/122 R |
| 5,470,034 | 11/1995 | Reeves . | |
| 5,680,054 | 10/1997 | Gauthier | 324/713 |

*Primary Examiner*—Mark T. Le
*Attorney, Agent, or Firm*—Rogers & Killeen; Scott Hayden

[57] ABSTRACT

This invention relates to a system and method of detecting a broken rail in a railway system. The track sensing circuitry of the present invention applies a voltage source at each end of a block of rails and senses the current flowing through the circuitry. The present invention will detect broken rails continuously in a block, even with a train present (except for a break directly beneath the train). Since the rail is continuously checked, the only restriction imposed on train spacing by this track circuit configuration is that only one train can be present in a block at a time.

23 Claims, 3 Drawing Sheets

BROKEN RAIL DETECTION SYSTEM AND METHOD

This application claims the benefit of U.S. Provisional Application No. 60/038,695, filed Feb. 7, 1997.

BACKGROUND OF THE INVENTION

The typical railroad industry track sensing circuits are used primarily to detect train occupancy of a block (section of track), with broken rail detection being a side benefit. In the typical circuit, broken rails are detected by applying a voltage across the rails and then sensing that voltage at the far end of the block. A broken rail will open the path and prevent voltage from reaching the far end of the block. Additionally, a train located in the block will short the rails together through the train axle and wheels and prevent voltage from reaching the far end of the block. Although these track sensing circuits work very well in a block based system where at least two blocks separate trains, the circuits will no longer adequately detect broken rails when the spacing of trains is reduced to less than two blocks.

The primary problem with the typical prior art track sensing circuits is that if a train is occupying a block (even just one axle of a train), the circuit cannot detect a broken rail in that same block because the presence of a train or a broken rail looks the same to the track sensing circuit, effectively masking the broken rail. Therefore, the closest safe spacing of trains, allowing time to stop after detection of a break, is the length of a block plus the safe stopping distance (including margins) of the train. The typical track sensing circuit does not utilize accurate train locations and moving block control systems and therefore significantly limit the potential productivity and efficiency improvements which will be made possible by accurate train location and moving block control systems.

The present invention will detect broken rails continuously in a block, even with a train present (except for a break directly beneath the train). Since the rail is continuously checked, the only restriction imposed on train spacing by this track sensing circuit configuration is that only one train can be present in a block at a time. In other words, trains must be spaced at least one (and only one) block apart (rear of train to front of following train). To maximize track throughput (trains per day over that section of track), blocks would be sized to match the shortest safe breaking distance of the trains that would use that track. Therefore, depending on the block size selected, a particular train's spacing would be determined either by that train's safe breaking distance or the block length, whichever is greater.

Accordingly, it is an object of the present invention to provide a novel method of detecting a break in a rail.

It is another object of the present invention to provide a novel method of determining the location of a broken rail.

It is yet another object of the present invention to provide a novel method of conducting a self test of the track sensing circuit to ensure proper operation.

It is still another object of the present invention to provide a novel method of detecting unknown railway cars or equipment located on the track rails.

It is a further object of the present invention to provide a novel method of determining the position of manual railway switches.

It is yet a further object of the present invention to provide a novel method of automatic backup in case one location in the track sensing circuit fails.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
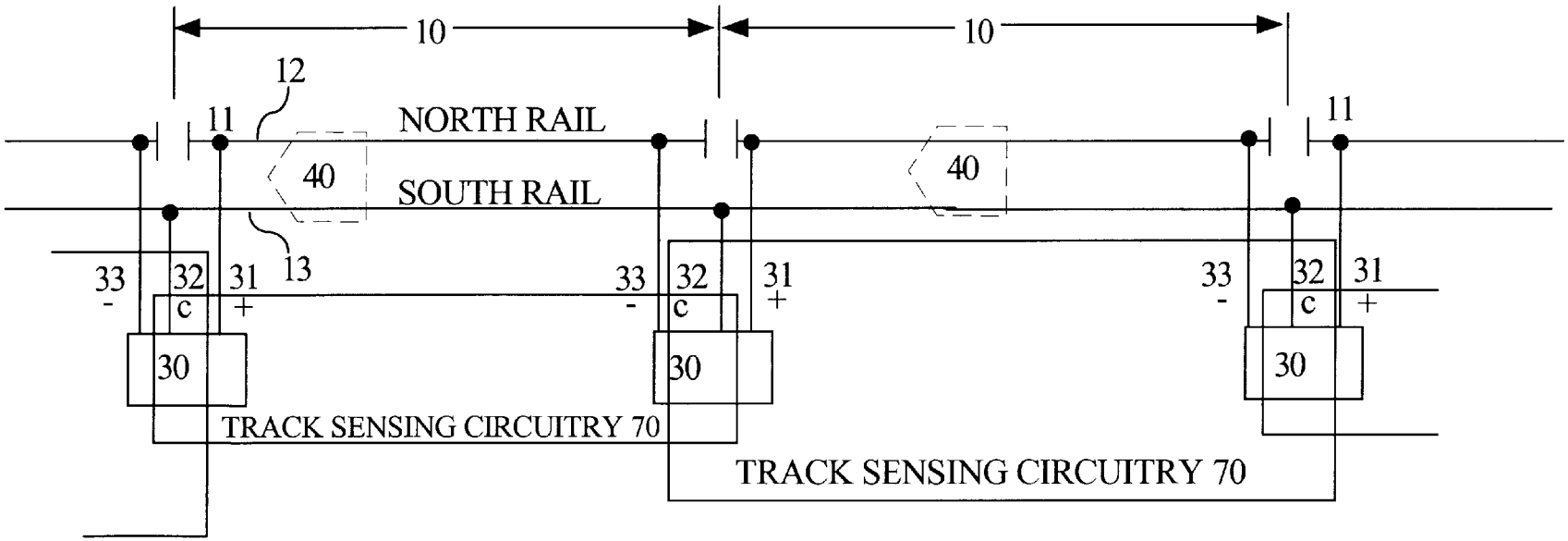
FIG. 1 is a pictorial diagram of a broken rail detection track configuration in accordance with the present invention.

Referring to FIG. 1, the track is broken into blocks 10 using electrically insulated joints 11 on one rail 12 with the other rail 13 left intact. At one end of each block 10, a low voltage DC source 30 is placed across the rails. The positive terminal 31 is connected to the (north) rail 12 with the common (negative) terminal 32 connected to the (south) rail 13. At the other end of the block 10, an equal low voltage DC source 30 is also connected across the rails. However, this source is connected with the opposite polarity. The negative terminal 33 is connected to the (north) rail 12 and the common (positive) terminal 32 is connected to the (south) rail 13. It should be understood that the polarities of the two sources can be reversed from what is shown as long as the polarities on the end of each rail in each block are opposite each other. The presence of a break in the rails can be determined by measuring the current through the rails 12 and 13 and the sources 30 by the track sensing circuitry 70, as discussed below in more detail.

Figure 2:
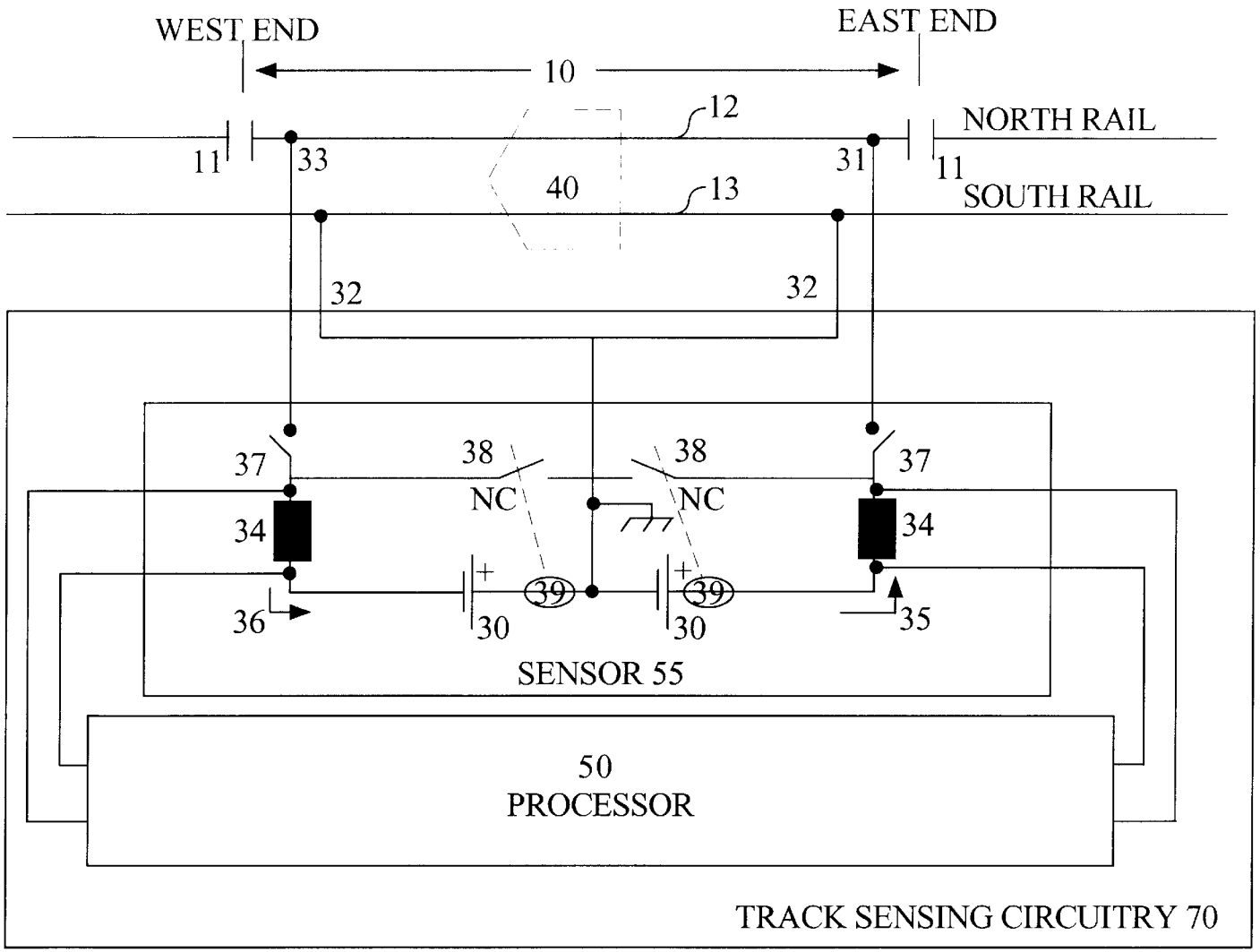
FIG. 2 is a simplified circuit diagram of a broken rail detection track sensing circuit in accordance with the present invention.

Referring to FIG. 2, with no trains present, the two sources 30 act in series as part of the same current loop causing current to flow through rails 12 and 13 and both sources. Track sensing circuitry 70 contains a sensor 55 and a processor 50. To determine whether the rails are continuous or broken, the current at both sources is determined by processor 50 which measures the voltage drop across a series resistor 34 in the sensor 55. Because the process of determining the current at both sources is the same, only the description of how the current at one of the sources is provided. It should be understood that processor 50 may use any of several methods instead of a voltage drop across series resistor 34 for determining current 35 at source 30 including current sense probes, relay coils or any other conventional method. The processor 50 compares the current 35 to a predetermined threshold and as long as the current 35 is above the predetermined threshold the rails 12 and 13 are indicated to be unbroken. The current 36 is determined in a similar fashion to that of the current 35 and compared to a predetermined threshold. It should be understood that the predetermined threshold is a function of the source DC voltage, block length, rail resistance and worst case ballast leakage. With no trains present, if a break occurs on either rail 12 or 13 in the block 10, both currents 35 and 36 will drop below their predetermined thresholds.

If a train 40 is present in the block 10, rails 12 and 13 will be shorted together through the wheels and axles of train 40. In this case, each source 30 will work independently of each other by forming a current loop through the rails and the train axles closest to that source. As long as there is no break between the source 30 and the train 40, enough current will flow in that independent loop to exceed the predetermined threshold and therefore, "no break" will be indicated in that independent current loop. If a break occurs anywhere between the source 30 and the train 40, the corresponding current 35 or 36 in that independent loop only will drop below the predetermined threshold indicating a broken rail. Accordingly, a break in the rails which occurs under a train will not be detected until after the train has passed over the break. In this situation, the broken rail will be detected immediately behind the train. Importantly, by noting the time of the detection and knowing the location of the train at that specific time, the location of the break can be fairly accurately determined.

The present invention also includes the ability to detect the location of trains. Referring to FIG. 2, as a train 40 travels through block 10 and approaches the west end of the block 10, the current 36 sensed by the sensor 55 in the independent current loop in the west end of the block 10 will increase due to the reduction of any rail series resistance in that current loop as the length of rail in the current loop between the train 40 and the west end of the block 10 decreases. The current 36 should peak just prior to the train 40 leaving the block 10 which provides a method of determining the location of the train 40 in the block 10. By creating a database of the historical values of the current 36 as the train 40 passes through the block 10, it will later be possible to determine the location of a train 40 in the block 10 based on the current 36.

To ensure that a short does not develop which could obscure the detection of a break, the present invention includes a method of self testing the broken rail detection system. The self test is conducted when no trains are present on the rails for a given block. To enter the self test mode, a central controller will open one of the normally closed contacts 37 in the sensor 55 which connects the source 30 to the rails. Because opening contact 37 at either end of block 10 results in a similar test, only a description of opening contact 37 in the east end of the block 10 is provided. By opening contact 37 in the east end of the block 10, the current loop is now broken and both currents 35 and 36 should drop to less than the predetermined values and a broken rail would be indicated. If the rails 12 and 13 are shorted anywhere in block 10, current 36 will continue to flow and will not drop below the predetermined threshold and will therefore indicate "no break."

As long as no trains are present, if both currents 35 and 36 do not drop below the predetermined threshold when either contact 37 is opened, this would constitute a short between rails 12 and 13. Importantly, this same self test mode for shorts could also be used to determine if a block 10 was occupied by an unknown car or rail equipment because the practical effect of any railway cars on the rails is to short the rails together.

The present invention includes an automatic backup in case one of the sources fails. For example, if power is lost or a failure is detected in source 30 at the east end of the block 10, relay 39 in the sensor 55 in the east end deenergizes which causes normally closed contact 38 in the east end to close which shorts rails 12 and 13 together so that source 30 in west end of the block 10, which has not lost power, would continue to power the track sensing circuit and still detect a broken rail in the block 10. Although this backup method would not be able to detect breaks at the end of a block opposite to the end which has not lost power when a train is present in the block, it would be a reasonable backup until the faulty circuitry could be repaired. With this backup approach, every other source 30 could fail, and broken rails would still be able to be detected by the track sensing circuits. However, train spacing in this instance would have to be increased to two blocks, one block plus safe breaking distance, if complete protection is required.

Figure 3:
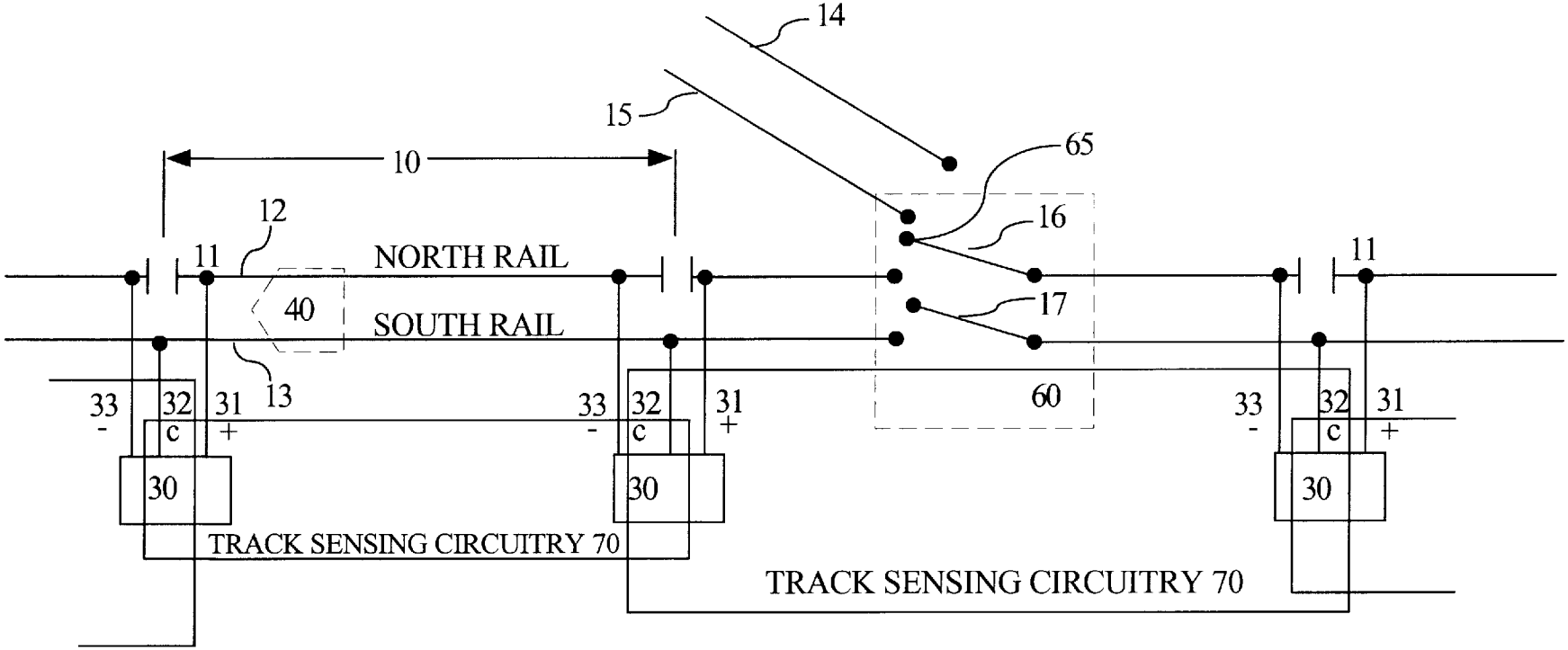
FIG. 3 is a pictorial diagram of another embodiment of a broken rail detection system in accordance with the present invention, illustrating the operation of the embodiment in a track switch configuration.

With reference to FIG. 3, one embodiment of the present invention has the ability to detect a manual throw switch in the wrong position. When the switch 60 is placed in the normal position rail 16 is electrically connected in series to rail 12 and rail 17 is electrically connected in series to rail 13. To assist in ensuring that electrical contact is made between rail 12 and rail 16, an auxiliary switching contact 65 may be carried at the free end of either rail 12 or rail 16. When switch 60 is in the reverse position, rails 16 and 17 are connected to rails 14 and 15, respectively, via the auxiliary switch contacts (if used). The track sensing circuitry 70 can be positioned such that the block 10 encompasses the switch 60. The manual switch 60 is wired in series with rails 12 and 13 such that a current loop is completed when the switch is positioned in the normal direction and the loop circuit is broken when the manual switch 60 is positioned in the reverse direction. By including the manual switch 60 in the block 10, the track sensing circuit will sense a "break" in the rails if the switch is in the reverse position and "no break" if the switch is in the normal position.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. In a track circuit comprising two or more electrically isolated rails, a method for detecting breaks in the rails comprising the steps of:

(a) electrically interrupting the first of said rails along its length to form plural blocks;

(b) applying a source of voltage having a first polarity at a first end of one of said blocks;

(c) applying a source of voltage having a second polarity at the other end of said one block;

(d) applying a voltage reference to the second of said rails; and, (e) measuring the current in said first rail.

2. The method of claim 1, further comprising the steps of:

(a) comparing said measured current against a predetermined current value; and, (b) providing a warning signal when said measured current is less than said predetermined current value.

3. The method of claim 1, further comprising the steps of:

(a) maintaining a historical indication of said measured current;

(b) providing a warning signal when said measured current is less that the historical indication.

4. The method of claim 1, further comprising the step of:

(a) testing the circuit formed in said first rail by disconnecting one of said sources of voltage from said first rail.

5. The method of claim 1, further comprising the steps of:

(a) providing a mobile short circuit between said first and second rails;

(b) moving the mobile short circuit along said first and second rails from the first end of said block to the other end of said block;

(c) determining the location of a break along the rails by the location of the mobile short circuit when a change in the measured current is detected.

6. A method of determining the presence of a rail vehicle along a track circuit comprising two or more electrically isolated rails, comprising the steps of:

(a) electrically interrupting the first of said rails along its length to form plural blocks;

(b) applying a source of voltage having a first polarity at a first end of one of said blocks;

(c) applying a source of voltage having a second polarity at the other end of said one block;

(d) applying a voltage reference to the second of said rails;

(e) measuring the current in said first rail at said first ends of said block;

(f) removing the source of voltage at the other of said ends of said block; and, (g) measuring the current in said first rail at said first end of said block after the source of voltage has been removed at said other end of said block.

7. A circuit for detecting a break in a track circuit comprising two rails, said circuit comprising:

a first rail having electrically isolated blocks along its length;

a second rail forming a substantially continuous electrical path;

a source of voltage of a first polarity electrically connected to a first end of one of said blocks;

a source of voltage of a second polarity electrically connected to the other end of said one of said blocks;

a common reference electrically connected to said second rail; and, means for determining the current flowing in said one of said blocks in said first rail.

8. The circuit of claim 7 further comprising means for selectively removing one of said sources of voltage from said first rail.

9. The circuit of claim 8 further comprising means for selectively shorting said rails to each other.

10. The circuit of claim 7 wherein said means for determining comprises means for applying said current across a resistor and means for determining the voltage drop across the resistor.

11. The circuit of claim 8 wherein said means for selectively removing comprises a normally-closed relay.

12. The circuit of claim 7 wherein said means for determining is located near one of said ends of said block.

13. A system for detecting a broken rail within a track circuit comprising plural of the circuits of claim 7, each of said circuits occupying adjacent ones of said blocks.

14. The system of claim 13 wherein the sources of voltage at adjacent ends of adjacent blocks are of opposite polarity.

15. The method of claim 1 wherein said measuring is performed near both ends of the block.

16. The method of claim 4 further comprising:

(a) measuring the current against predetermined current value; and, (b) providing a failure indication if the measured current is not below predetermined current value.

17. In a track circuit comprising a first set of two electrically isolated rails, a manual throw switch and a second set of electrically isolated rails, said manual throw switch selectively moving a portion of said second set of rails adjacent said first set of rails such that a vehicle travelling along said first set of rails may be selectively switched to travel along said second set of rails, a method of determining whether the manual throw switch is in the normal position wherein a vehicle traveling along said first set of rails continues to travel on first set of rails rather than on said second set of rails, comprising the steps of:

(1) electrically interrupting the first rail of said first set of rails along its length to form plural blocks, one of said blocks including the manual throw switch;

(2) applying a source of voltage having a first polarity at a first end of said one block;

(3) applying a source of voltage having a second polarity at the other end of said one block;

(4) electrically interrupting the first rail at the manual throw switch;

(5) applying a voltage reference to the second of said rails in said first set of rails;

(6) connecting contact across interrupted rail at the manual throw switch when the switch is in the normal position; and (7) measuring the current in said first rail of said first set of rails at both ends of said block.

18. In a train track circuit comprising two or more electrically isolated train rails and a train traveling in contact with the rails, a method of detecting a break in the rails comprising:

(a) applying a first source of voltage having a first polarity at a first end of the first of said train rails;

(b) applying a second source of voltage having a second polarity at the other end of the first of said train rails;

(c) applying a voltage reference to the second of said rails;

(d) shorting the train rails together to form a first current loop through a first set of wheels and axle on the train and said first source of voltage;

(e) shorting the train rails together to form a second current loop through a second set of wheels and axle on the train and said second source of voltage;

(f) measuring the current in said first and second current loops.

19. The method of claim 18 further comprising determining the location of the train by comparing the measured loop currents with historical values for the loop currents.

20. The method of claim 18 further comprising the step of locating the break in the rails by determining the location of the train when the break is detected.

21. A circuit for detecting a break in a train track circuit comprising two rails while a train is traveling over the rails, said circuit comprising:

a first source of voltage of a first polarity electrically connected to a first end of the first of said rails;

a second source of voltage of a second polarity electrically connected to the other end of the first of said rails;

a common reference electrically connected to the second rail at both ends of said second rail;

a first electrical short between said rails through a first set of wheels and axle of the train forming a first current loop;

a second electrical short between said rails through a second set of wheels and axle of the train forming a second current loop;

means for determining the current flowing in each of said current loops.

22. The circuit of claim 21 further comprising means for determining the location of the train by comparing the measured loop currents with historical values for the loop currents.

23. The circuit of claim 21 further comprising means for determining the location of the brake in the rails by determining the location of the train when the break in the rails is detected.

* * * * *